United States Patent [19]

Benedetti et al.

[11] Patent Number: 4,971,087

[45] Date of Patent: Nov. 20, 1990

[54] ARRANGEMENT OF PACKING MACHINES

[75] Inventors: Paolo Benedetti; Fausto Filippi, both of Modena, Italy

[73] Assignee: Tetra Dev-Co, Modena, Italy

[21] Appl. No.: 200,363

[22] Filed: May 31, 1988

[30] Foreign Application Priority Data

Jul. 13, 1987 [IT] Italy ..... 21261 A/87

[51] Int. Cl.[5] ..... B08B 3/04

[52] U.S. Cl. ..... 134/104.1; 134/169 R; 134/103; 134/171; 141/89; 141/91

[58] Field of Search ..... 134/59, 104, 103, 166 C, 134/168 C, 171, 169 R, 100 C; 141/89, 91; 222/148

[56] References Cited

U.S. PATENT DOCUMENTS

| | | | |
|---|---|---|---|
| 1,425,960 | 8/1922 | Haller | 141/91 |
| 2,189,950 | 2/1940 | Gump | 222/148 X |
| 2,259,644 | 10/1941 | Kling | 134/168 C |
| 3,276,694 | 10/1966 | Alexander | 134/169 R X |
| 3,536,081 | 10/1970 | Riess | 134/168 C X |
| 3,677,272 | 7/1972 | Schrank et al. | 134/166 C X |
| 3,693,640 | 9/1972 | Wettlen et al. . | |
| 3,716,083 | 2/1973 | Tuma et al. . | |
| 3,911,642 | 10/1975 | Ernstsson et al. . | |
| 3,912,535 | 10/1975 | Rauser . | |
| 3,945,536 | 3/1976 | Doak | 222/148 |
| 3,970,426 | 7/1976 | Stark et al. . | |
| 3,991,797 | 11/1976 | Uth et al. | 134/166 C X |
| 4,059,858 | 11/1977 | Lambel et al. | 134/166 C X |
| 4,099,914 | 7/1978 | Gustafsson et al. . | |
| 4,136,719 | 1/1979 | Kronseder et al. | 141/91 X |
| 4,213,795 | 7/1980 | Ernstsson et al. . | |
| 4,218,265 | 8/1980 | Fuchs et al. . | |
| 4,350,187 | 9/1982 | Trusselle et al. | 141/91 X |
| 4,527,377 | 7/1985 | Hayasni et al. | 141/91 X |
| 4,534,494 | 8/1985 | Hautemont | 141/91 X |

*Primary Examiner*—Frankie L. Stinson

*Attorney, Agent, or Firm*—Burns, Doane, Swecker & Mathis

[57] ABSTRACT

In packing machines which have a filling pipe with two or more ducts, a rinsing of the filling pipe with cleaning fluid may lead to only one duct being properly cleaned. In order to prevent this, an arrangement is provided on packing machines which have a coupling part provided with valves with passages which are coupled in series with respective ducts in the filling pipe. The valve is adapted so that it is acted on towards the closed position by the cleaning fluid flowing past and thus limits the flow through the one duct so that the other duct too is assured of an adequate flow for effective cleaning.

5 Claims, 1 Drawing Sheet

ARRANGEMENT OF PACKING MACHINES

BACKGROUND OF THE INVENTION

1. Field of the Invention

The present invention relates to an arrangement on packing machines for the cleaning of a filling pipe of the type which has two or more ducts for the supply of contents or gas, this arrangement comprising a pump for the pumping of cleaning fluid and devices for the steering of the fluid flow to the filling pipe.

2. Description of Related Art

Machines for the manufacture of packing containers for fluid contents, e.g., milk, juice, soups or sauces, usually fill the packing containers with the help of a filling pipe when they are in a more or less finished state, e.g., in the form of a coherent tube or of separate packing containers open at the top. The filling pipe here extends with a free end partly down into the packing containers, and the opposite end of the filling pipe is connected via a system of ducts or valves to a product line for the supply of contents from a conventional contents tank. Frequently the filling pipe comprises a number of supply ducts which may be intended for different parts of the contents (e.g. pieces of vegetable and meat via one duct and a liquid part of soup via another duct) or they may be intended for contents and an inert gas respectively, the latter having the object of filling up the so-called head-space in the packing container and preventing contact between the contents and the surrounding atmosphere.

When a machine comprising a filling pipe system of the above-mentioned type is to be washed after completed package production, this is done with the help of a washing or cleaning fluid which is pumped through the filling pipe and the valves connected to the filling pipe so as to remove residues of contents. Generally this is done over a relatively long period of time, and in order to utilize the cleaning fluid in an optimum manner, the same is circulated over a large part of the time in a closed system realized with the help of connecting ducts, which comprises also the filling pipe and product valves connected to the same. The cleaning effect required is achieved only if the cleaning fluid can be circulated at a certain minimum rate. In packing machines intended for the manufacture of packing containers of relatively small size the outer dimensions of the filling pipe are limited for obvious reasons, which means that the area of the supply ducts is relatively small. As a result the flow of cleaning fluid will be reduced, which implies that the cleaning effect is impaired in the parts of the machine connected to the circulation system where the free area is larger, e.g., in the valve body and similar passages. The flow through the said parts can be increased by coupling the ducts of the filling pipe in parallel so that the cleaning fluid passes not only through the contents duct but also, e.g., through the gas duct, even if the same normally is not in contact with the contents and therefore, strictly speaking, does not require to be cleaned. In this way, however, a larger flow through the filling pipe is made possible so that the necessary washing effect can be achieved also with regard to the valve body and other larger passages in the system. However, it is a disadvantage of this so-called parallel-washing that it is not possible to determine from the outside with certainty whether the contents duct is cleaned in a proper manner. This is due to the fact that if, for example, the contents duct is wholly blocked by contents, the cleaning fluid is conducted via the parallel gas duct so that the circulation system appears to function perfectly, in spite of no cleaning fluid at all flowing through the contents duct. Even minor blockages of the contents duct may lead to an impaired washing effect, which means that there is a danger of a loss of production when the machine is to be started again and the manufacture of filled packing containers is commenced.

SUMMARY OF THE INVENTION

It is an object of the present invention to provide an arrangement which makes it possible to avoid the abovementioned disadvantages and ensure that the cleaning of the different ducts of the filling pipe takes place in an effective and reliable manner.

It is a further object of the present invention to provide an arrangement which during the cleaning process makes it possible to determine from the outside whether cleaning is taking place in the desired manner.

It is a further object of the present invention to provide an arrangement for the cleaning of a filling pipe with several ducts, this arrangement being simple to manufacture and use and provide effective cleaning at low cost.

These and other objects have been achieved in accordance with the invention in that an arrangement of the type mentioned in the introduction has been given the characteristic that it has a coupling part connectable to the ducts which has a wall partially blocking one duct with a valve-controlled flow opening.

BRIEF DESCRIPTION OF THE DRAWINGS

The present invention will now be described in more detail with special reference to the attached schematic drawings which show a preferred embodiment of the arrangement in accordance with the invention, wherein only the details indispensable for an understanding of the invention have been included.

DETAILED DESCRIPTION OF A PREFERRED EMBODIMENT

Figure 1:
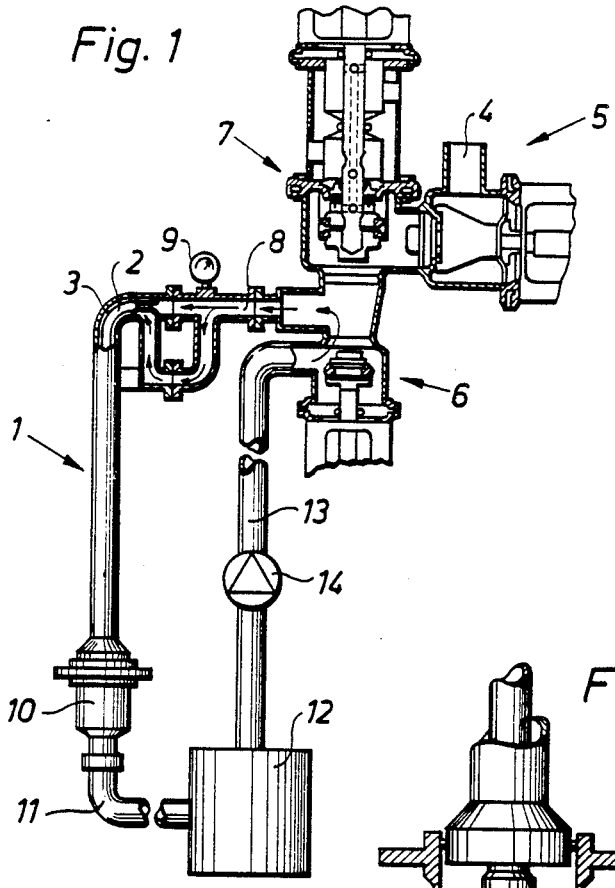
FIG. 1 is a view partly in section of the arrangement in accordance with the invention as it is used together with a filling sytem in a packing machine of a known type.

The arrangement in accordance with the invention, as mentioned previously, is intended to be used together with a packing machine of a conventional type. This packing machine, which for example may be of the type which is described in Swedish patent application no. 8202302-9, comprises a filling system for the filling of wholly or partly preformed packing containers with liquid contents. The contents are conducted to the individual packing containers via a filling pipe 1 which comprises a contents duct 2 and a gas duct 3 concentrically surrounding the same. The contents duct 2 is connected at its upper or rear end to a product line 4 via which the contents are conducted to the packing machine, the supply being controllable with the help of a product valve 5. The rear or upper end of the gas duct 3 is connected to a source of inert gas which, however, is not shown on the drawing. The arrangement comprises, moreover, a washing valve 6, by means of which cleaning fluid can be made to flow through the filling pipe 1, and a shutoff valve 7 which comprises a vapour lock and is used in the cleaning and sterilizing of the filling system.

In operation, i.e., when the packing machine manufactures and fills packing containers, both ducts 2,3 of the filling pipe 1 are connected to the product line 4 and a container of inert gas (not shown) respectively. When the filling system is to be washed or cleaned the filling pipe is coupled into a circulation system for cleaning fluid, the contents duct 2 and the gas duct 3 being connected in parallel with the help of a branch pipe 8 which is placed at the upper end of the filling pipe 1. The branch pipe 8 is provided with a pressure gauge 9 so as to allow reading of the instantaneous pressure in the cleaning fluid when it passes the branch pipe 8. At the lower end of the filling pipe 1 is connected a coupling part 10 which in turn at its lower end is connected via a return line 11 to a container 12 for cleaning medium in liquid form, e.g., caustic soda. From the container 12 a washing duct 13 leads substantially vertically upwards to the washing valve 6. The washing duct 13 passes a pump 14 of known type for cleaning fluid.

The coupling part 10 at its upper end comprises a coupling 15 of the bayonet type so as to make possible a liquid-tight connection to the lower end of the filling pipe 1. The coupling part 10, which is substantially cylindrical, has an internal, concentrically situated passage 16 which is coupled together with the contents duct 2, and a passage 17 placed concentrically around the passage 16, which is in connection with the gas duct 3. The two passages 16, 17 open via a perforated, horizontal wall 18 into a common space 19 at the lower end of the coupling part 10, this space 19 being connected by means of a further bayonet coupling to the return line 11 mentioned earlier.

The wall 18 is designed as an internal flange in the coupling part 10 and has vertical cylindrical part which is connected in a liquid-tight manner to the lower end of the passage 16. The said cylindrical part supports on the outside an annular valve body 20 which preferably has a conical or bell-shaped form and which is maintained at a distance above the wall 18 with the help of a spring 21, which is in the form of a helical compression spring, or preferably, a wave-spring. The wall 18 comprises a number of flow openings 22, which are placed in annular arrangement and at such a distance from the vertical centre axis of the coupling part 10 that they are covered, wholly or partly, by the valve body 20 when the same is in its lower position, where it rests with a sealing surface facing downwards against the wall 18. The valve body 20 together with the flow openings in the wall 18 forms a passage creating a Venturi effect, which endeavours to move the valve body downwards to rest against the valve seat 18 when the cleaning fluid flows past the top, which will be explained in more detail in the following. When the packing machine with the arrangement in accordance with the invention, after operation over a longer or shorter time, is to be stopped, the connection of the filling pipe to the product line 4 is cut off first of all with the help of the product valve 5, which is put into its closed position shown in FIG. 1.

Figure 2:
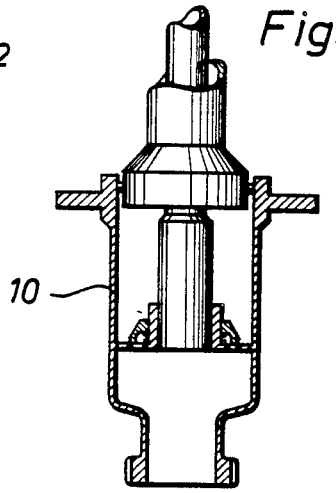
FIG. 2 is a view on a larger scale and partly in section of a coupling part in accordance with the invention in a closed position.
Figure 3A:
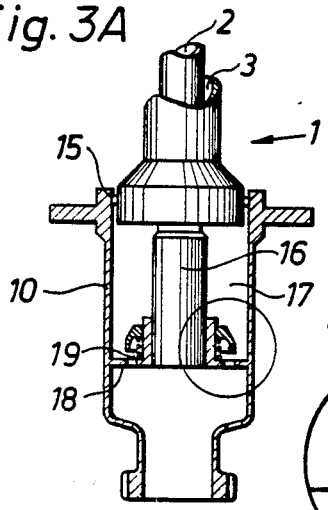
FIGS. 3A and 3B is identical with FIG. 2 but is a view of the coupling part in accordance with the invention in an open position.
Figure 3B:
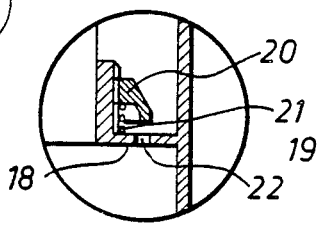

Subsequently the original connecting part (not shown), which connects the filling pipe with the valve housing and inert gas source respectively, is removed, and the branch pipe 8 with the pressure gauge 9 is placed so that it connects, as shown in FIG. 1 the valve housing provided with the valves 5,6 and 7 to the two ducts 2,3 of the filling pipe 1, which thus are coupled in parallel. After the outside of filling pipe 1 has possibly been cleaned and valves, extension pipe or other components located at the lower part of the filling pipe 1 have been removed, the lower end of the filling pipe is connected in a liquid-tight manner to the upper opening of the coupling part 10 (FIGS. 2,3). The two ducts 2,3 thus will converge via the coupling part 10 and be connected to the return duct 11 and the container 12 for cleaning fluid, from which the washing duct 13 via the pump 14 conducts to the washing valve 6. As a result a closed circulation system is produced comprising the two ducts 2,3 of the filling pipe 1 (coupled in parallel), the coupling part 10, the return duct 11, the container 12, the washing duct 13, the valve housing and the branch pipe 8. The washing now commences in that the washing pump 14 is started and the washing valve 6 is opened, thus allowing the cleaning fluid (usually caustic soda) to circulate through the system as indicated by means of arrows. In the course of this the cleaning fluid will flow through the valve housing, via the branch tube 8 and through the contents duct 2 and the gas duct 3. The circulation of cleaning fluid continues during a certain, predetermined time whilst the flow through the pump 14 as well as the pressure in the branch pipe 8 are continuously monitored.

The cleaning fluid flowing through the system, after it has passed the contents duct 2 and the gas duct 3, enters into corresponding passages 16 and 17 respectively of the coupling part 10. The cleaning fluid flowing through the contents duct 2 and the passage 16 can freely pass the coupling part 10 to be conducted further into the circulation system. The cleaning fluid which passes the gas duct 3 is conducted into the outer, annular passage 17 of the coupling part 10 and thus has to pass the valve body 20 and the flow openigs 22 in the wall 18 serving as a valve seat. Owing to the Venturi effect the cleaning fluid will act, against the effect of the spring 21 upon the valve body 20 in the direction towards its lower (that is to say closed) position, but in normal operation the Venturi effect will not be strong enough to enable it to close the valve. However, the increased resistance causes considerably more than half the cleaning fluid flow to pass through the contents duct 2, and in a packing machine of the aforementioned type the total flow of approx. 5500 l/h is divided so that approx. 1500 l/h pass the gas duct 3 and the outer passage 17, whereas approx. 4000 l/h pass through the central contents duct 2 and the passage 16. This is desirable, since it is only the contents duct 2 which normally comes into contact with the contents and which, therefore, requires cleaning.

When larger residues of contents, particles or other improper objects are present in the contents duct it can happen that the latter becomes wholly or partially blocked. If this happens in the arangement in accordance with the invention, a greater part of the cleaning fluid will seek to pass through the gas duct 3 whereby the increased flow through the passage and past the valve body 20 creates a vigorous Venturi effect which is capable of overcoming the force of the spring 21 and pressing the valve body 20 further downwards, closer to the wall 18 serving as a valve seat. As a result the flow through the passage 17 and the gas duct 3 is limited further so that, even if the contents duct 2 is completely blocked, it is not allowed to rise to any appreciable degree (max. approx. 25% above the normal value, that is to say at the most approx. 1900 l/h in the aforementioned machine type). This results in a pressure increase in the system which can be read with the help of the pressure gauge 9, so that an indication of the contents duct 2 being wholly or partially blocked is obtained. The pressure increase created naturally brings with it also a rise in pressure to a corresponding degree in the contents duct 2, which contributes to any residues of contents sticking in the contents duct 2 being pressed out and removed more readily. The arrangement in accordance with the invention thus creates better preconditions for an effective cleaning of the contents duct 2 even if the same is wholly or partially blocked at the start. If, in spite of this, a cleaning of the contents duct 2 should prove impossible, this is clearly indicated by the pressure gauge 9, so that the machine operator can dismantle the filling pipe and manually clean the same. When a centrifugal pump is used the pressure rise in the cleaning fluid will be small and difficult to read on the pressure gauge 9. However, in any case the reduced flow will result in a detectable change of the emptying rate in the tank 12, which indicates that the duct 2 is partially blocked. After the cleaning or washing process has been completed the valve 7 too is closed, whereupon the system possibly can also be sterilized with the help of some suitable sterilizing agent, e.g., hydrogen peroxide, which is allowed to circulate through the filling pipe. This technique is known, however, and does not require to be described in detail in this context.

While this invention has been illustrated and described in accordance with preferred embodiments, it is recognized that variations and changes may be made therein without departing from the invention as set forth in the claims.

We claim:

1. An arrangement on packaging machines for cleaning a filling pipe of the type which has two or more ducts for supplying contents and gas, the arrangement comprising:

a pump for the pumping of cleaning fluid;

means for steering the fluid flow to the filling pipe;

a coupling part connectable to the ducts, said coupling part having a wall partially blocking one duct with a valve-controlled flow opening;

wherein the coupling part comprises a valve body which is spring-loaded towards the open position and is adapted, on increasing rate of flow, to reduce the area of the flow opening.

2. An arrangement in accordance with claim 1, further comprising a spring adapted to act upon the valve body in the direction from the wall towards the maximum open position.

3. An arrangement in accordance with claim 1, wherein the spring is an integrated part of the valve body which is manufactured from a flexible material.

4. An arrangement in accordance with claim 2, wherein the spring is a wave-spring which is situated between the valve body and the wall provided with the flow opening.

5. An arrangement in accordance with claim 1, wherein on increasing flow the valve body is successively moved, against the effect of the spring to a position resting against the wall, wherein the valve body reduces the size of the flow opening to a predetermined minimum value.

* * * * *